US009914894B2

(12) United States Patent
Iovine et al.

(10) Patent No.: US 9,914,894 B2
(45) Date of Patent: Mar. 13, 2018

(54) LUBRICANT COMPOSITION

(71) Applicant: TOTAL MARKETING SERVICES, Puteaux (FR)

(72) Inventors: Raphaele Iovine, Mornant (FR); Carine Pizard, Saint Genis Laval (FR); Philippe Marechal, Ciron (FR)

(73) Assignee: Total Marketing Services, Puteaux (FR)

( * ) Notice: Subject to any disclaimer, the term of this patent is extended or adjusted under 35 U.S.C. 154(b) by 172 days.

(21) Appl. No.: 14/411,008

(22) PCT Filed: Jun. 28, 2013

(86) PCT No.: PCT/EP2013/063669
§ 371 (c)(1),
(2) Date: Dec. 23, 2014

(87) PCT Pub. No.: WO2014/001521
PCT Pub. Date: Jan. 3, 2014

(65) Prior Publication Data

US 2015/0203778 A1 Jul. 23, 2015

(30) Foreign Application Priority Data

Jun. 29, 2012 (FR) ..... 12 56208

(51) Int. Cl.
*C10M 169/06* (2006.01)
*C10M 129/76* (2006.01)
*C10M 129/74* (2006.01)

(52) U.S. Cl.
CPC ..... *C10M 129/76* (2013.01); *C10M 129/74* (2013.01); *C10M 2203/1025* (2013.01); *C10M 2205/022* (2013.01); *C10M 2205/028* (2013.01); *C10M 2205/0285* (2013.01); *C10M 2207/026* (2013.01); *C10M 2207/283* (2013.01); *C10M 2207/289* (2013.01); *C10M 2209/084* (2013.01); *C10M 2215/064* (2013.01); *C10M 2215/28* (2013.01); *C10M 2219/068* (2013.01); *C10M 2223/043* (2013.01); *C10M 2223/045* (2013.01); *C10M 2227/066* (2013.01); *C10N 2220/022* (2013.01); *C10N 2220/025* (2013.01); *C10N 2220/026* (2013.01); *C10N 2220/027* (2013.01); *C10N 2220/028* (2013.01); *C10N 2230/06* (2013.01); *C10N 2230/42* (2013.01); *C10N 2230/43* (2013.01); *C10N 2230/45* (2013.01); *C10N 2230/54* (2013.01); *C10N 2240/102* (2013.01); *C10N 2240/103* (2013.01); *C10N 2240/104* (2013.01)

(58) Field of Classification Search
CPC ..... C10M 2207/125
USPC ..... 508/591, 519
See application file for complete search history.

(56) References Cited

U.S. PATENT DOCUMENTS

| | | | | |
|---|---|---|---|---|
| 5,064,546 | A | 11/1991 | Dasai | |
| 8,097,570 | B2 | 1/2012 | Boitout et al. | |
| 8,334,245 | B2 | 12/2012 | Lancon et al. | |
| 2005/0070450 | A1 | 3/2005 | Roby et al. | |
| 2005/0075254 | A1 | 4/2005 | Pollock et al. | |
| 2008/0176778 | A1 | 7/2008 | Seemeyer et al. | |
| 2010/0275508 | A1 | 11/2010 | Dolmazon et al. | |
| 2011/0059877 | A1* | 3/2011 | Obiols | C10M 161/00 508/186 |
| 2011/0077177 | A1 | 3/2011 | Doyen | |
| 2011/0092403 | A1 | 4/2011 | Lancon et al. | |
| 2011/0306526 | A1 | 12/2011 | Germanaud et al. | |
| 2012/0077721 | A1 | 3/2012 | Dolmazon et al. | |
| 2012/0238481 | A1* | 9/2012 | Kamano | C10M 135/20 508/509 |
| 2013/0267447 | A1 | 10/2013 | Bardin | |
| 2014/0235516 | A1 | 8/2014 | Lancon | |

FOREIGN PATENT DOCUMENTS

| | | | |
|---|---|---|---|
| JP | 2005082709 | A | 3/2005 |
| WO | WO-2005030912 | A2 | 4/2005 |
| WO | WO-2010064220 | A1 | 6/2010 |

OTHER PUBLICATIONS

English Translation of the International Preliminary Report on Patentablity, IB/Geneva, issued Dec. 31, 2014, incorporating the English Translation of the Written Opinion of the ISA.
U.S. Appl. No. 12/745,861, filed Nov. 19, 2010, Jerome Obiols Ludivine Pidol Jean-Marc Savoie Isabelle Rogues De Fursac.
U.S. Appl. No. 13/259,820, filed Sep. 23, 2011, Nelly Domazon Jose Sanitago Yvan Storet Frederic Tort.
U.S. Appl. No. 13/993,239, filed Jun. 11, 2013, Franck Bardin.
U.S. Appl. No. 14/347,873, filed Mar. 27, 2014, Denis Lancon.

* cited by examiner

*Primary Examiner* — Vishal Vasisth
(74) *Attorney, Agent, or Firm* — Harness, Dickey & Pierce, PLC

(57) ABSTRACT

The present disclosure concerns a lubricant composition including: at least one base oil; and at least two glycerol esters $E_1$ and $E_2$, ester $E_1$ being an ester of glycerol and of a $C_{12}$-$C_{26}$ carboxylic acid and ester $E_2$ being an ester of glycerol and of a $C_4$-$C_{10}$ carboxylic acid. The lubricant composition has good friction properties, and the use thereof promotes fuel savings.

14 Claims, No Drawings

LUBRICANT COMPOSITION

CROSS-REFERENCE TO RELATED APPLICATIONS

This application is a National Phase Entry of International Application No. PCT/EP2013/063669, filed on Jun. 28, 2013, which claims priority to French Patent Application Serial No. 1256208, filed on Jun. 29, 2012, both of which are incorporated by reference herein.

TECHNICAL FIELD

The present invention relates to a lubricant composition comprising at least two glycerol esters. This combination of two glycerol esters makes it possible to obtain a lubricant composition having a very low friction coefficient. Use of this lubricant composition promotes fuel savings. It can in particular be used for lubricating the engines of light vehicles, heavy goods vehicles (HGV) or ships.

BACKGROUND

Because of environmental concerns, there are increasing efforts to reduce polluting emissions and achieve fuel savings in vehicles. The nature of the engine lubricant has an influence on these two phenomena. The behaviour of the lubricant in the reduction of friction has an impact on fuel consumption. It is mainly the quality of the base oils, alone or in combination with polymers improving the viscosity index (VI) and friction modifying (FM) additives, that gives the lubricant its "Fuel Eco" (FE) properties.

Among the friction modifiers used conventionally, molybdenum dialkyldithiocarbamate (or Mo-DTC), which is an inorganic friction modifier, and glycerol monooleate (or GMO), which is an organic friction modifier may be mentioned. GMO, in contrast to Mo-DTC, is a friction modifier which has the advantages that it does not contain ash, phosphorus or sulphur and is produced from raw materials of renewable origin. However, its friction properties are not as good as those of Mo-DTC, for example. It would therefore be desirable to be able to formulate lubricant compositions with friction modifiers obtained from compounds originating from raw materials of renewable origin, not comprising ash, having improved friction properties relative to lubricant compositions comprising GMO.

The use of a mixture of esters for reducing friction in engines is known from U.S. Patent Publication No. 2005/075254 and PCT Patent Publication No. WO2005/030912. These esters are obtained from an esterification reaction between a polyol and a cyclic fatty acid comprising from 12 to 28 carbon atoms and/or a branched fatty acid comprising from 12 to 28 carbon atoms. U.S. Patent Publication No. 2008/176778 describes a lubricant composition in the form of an emulsion. This composition in particular comprises a lipophilic compound and an emulsifier. The lipophilic compound can in particular be selected from caprylate or caprate triglycerides and the emulsifying compound can in particular be glycerol monooleate.

U.S. Pat. No. 5,064,546 describes a lubricant composition comprising a base oil and a friction modifier, which can be a coconut oil. The document JP2005082709 describes a method for reducing friction in engines using a lubricant composition comprising at least an glycerol ester. These esters are obtained from carboxylic acids comprising from 10 to 18 carbon atoms. U.S. Patent Publication No. 2005/070450 describes lubricant compositions comprising a product obtained by a transesterification reaction between an ester of glycerol and an ester of polyol different from glycerol.

The present invention therefore relates to lubricant compositions in particular for engines, comprising at least two glycerol esters with different chemical natures. The combination of these two glycerol esters of different chemical natures makes it possible to obtain good performance in terms of friction and in terms of fuel economy.

SUMMARY

A subject of the present invention is lubricant compositions in particular for engines, comprising at least two friction modifier additives not supplying any sulphated ash, sulphur or phosphorus; these additives replace, totally or partially, the conventional additives used in this type of application, such as molybdenum dialkyldithiocarbamate or glycerol monooleate. Moreover, these friction modifying additives that do not supply any sulphated ash, in combination with one another, allow said lubricant compositions to retain optimum properties in terms of fuel economy (also called Fuel Eco) while having a low or very low level of sulphated ash, sulphur, and phosphorus. The compositions according to the invention are lubricant compositions in particular for engines comprising:

a) at least one base oil,
b) at least one ester of glycerol and of a $C_{12}$ to $C_{26}$ carboxylic acid, denoted $E_1$,
c) at least one ester of glycerol and of a $C_4$ to $C_{10}$ carboxylic acid, denoted $E_2$.

In an embodiment of the invention, the lubricant composition can comprise at least one base oil and at least two glycerol esters $E_1$ and $E_2$, glycerol ester $E_1$ being an ester of glycerol and of a $C_{12}$ to $C_{26}$ carboxylic acid, and glycerol ester $E_2$ being an ester of glycerol and of a $C_4$ to $C_{10}$ carboxylic acid, said ester $E_1$ is a mixture of glycerol monoesters, glycerol diesters, glycerol triesters and free glycerol and said ester $E_2$ is a mixture of glycerol monoesters, glycerol diesters, glycerol triesters and free glycerol. Advantageously, the lubricant compositions of the invention allow fuel savings to be made during the phase of engine starting relative to the lubricant compositions comprising Mo-DTC. Thus, a subject of the invention is a lubricant composition comprising at least one base oil and at least two glycerol esters $E_1$ and $E_2$, glycerol ester $E_1$ being an ester of glycerol and of a $C_{12}$ to $C_{26}$ carboxylic acid, and glycerol ester $E_2$ being an ester of glycerol and of a $C_4$ to $C_{10}$ carboxylic acid.

In a variant of the invention, the glycerol esters $E_1$ and $E_2$ are selected independently from the glycerol monoesters, diesters, and triesters and mixtures thereof. In a variant of the invention, the carboxylic acids of the glycerol esters $E_1$ and $E_2$ are saturated or unsaturated, linear or branched carboxylic acids, optionally substituted with hydroxyl and/or epoxide groups. In a variant of the invention, the lubricant composition can also comprise glycerol.

In a variant of the invention, glycerol ester $E_1$ is an ester of glycerol and of a $C_{14}$ to $C_{24}$, preferably $C_{16}$ to $C_{22}$, more preferably $C_{18}$ to $C_{20}$ carboxylic acid. In a variant of the invention, glycerol ester $E_1$ is an ester of glycerol and of a $C_{12}$ to $C_{26}$ carboxylic acid, the hydrocarbon chain of the carboxylic acid comprising at least two unsaturations. In a variant of the invention, glycerol ester $E_2$ is an ester of glycerol and of a $C_5$ to $C_9$, preferably $C_6$ to $C_8$, more preferably $C_7$ carboxylic acid.

In a variant of the invention, glycerol ester $E_1$ is selected from the glycerol linoleates and mixtures thereof, and glycerol ester $E_2$ is selected from the glycerol heptanoates and mixtures thereof. In a variant of the invention, the sum of the masses of the glycerol esters $E_1$ and $E_2$, and optionally of the glycerol, represents 0.1 to 5% by mass, relative to the total mass of the lubricant composition, preferably from 0.2 to 4%, more preferably from 0.5 to 3%, even more preferably from 1 to 2%. In a variant of the invention, the mass ratio of the glycerol ester(s) $E_1$ to the glycerol ester(s) $E_2$ is comprised between 10:1 and 1:10, preferably between 5:1 and 1:5, more preferably between 2:1 and 1:2, and even more preferably is equal to 1:1.

In a variant of the invention, the lubricant composition can have a level of sulphated ash less than or equal to 0.8% measured according to the standard ASTM D874, preferably less than or equal to 0.5%. In a variant of the invention, the lubricant composition can have a level of phosphorus less than or equal to 900 ppm measured according to the standard ASTM D5185, preferably less than or equal to 500 ppm. In a variant of the invention, the lubricant composition can have a level of sulphur less than or equal to 0.32% measured according to the standard ASTM D5185, preferably less than or equal to 0.3%, more preferably less than or equal to 0.2%.

In a variant of the invention, the lubricant composition can have a kinematic viscosity at 100° C. measured according to the standard ASTM D445 comprised between 3.8 and 41 cSt. In a variant of the invention, the lubricant composition can be free from molybdenum-based friction modifying additive such as Mo-DTC. In a variant of the invention, the lubricant composition is an anhydrous composition. In a variant of the invention, the lubricant composition is in the form of a homogeneous solution.

Another subject of the present invention relates to the use of a lubricant composition as defined above for reducing the fuel consumption of light vehicles, heavy goods vehicles or ships. Another subject of the invention relates to an engine oil comprising at least one lubricant composition as defined above. In a variant of the invention, the engine oil can be of grade 5W-30 according to the SAE J300 classification. In a variant of the invention, the engine oil can have a viscosity index greater than or equal to 130, preferably greater than or equal to 150, preferably greater than or equal to 160.

Another subject of the present invention relates to a hydraulic oil, a transmission oil, a gear oil, a power steering fluid, a shock absorber fluid, a brake fluid comprising at least one lubricant composition as defined above. Preferably, the transmission oil is a gearbox oil. Another subject of the present invention relates to the use of at least two glycerol esters $E_1$ and $E_2$, in a base oil, said ester $E_1$ being an ester of glycerol and of a $C_{12}$ to $C_{26}$ carboxylic acid, said ester $E_2$ being an ester of glycerol and of a $C_4$ to $C_{10}$ carboxylic acid for reducing the fuel consumption of light vehicles, heavy goods vehicles or ships. Another subject of the present invention is a process for the lubrication of at least one mechanical part of an engine, said process comprising a step in which said mechanical part is brought into contact with at least one lubricant composition as defined above.

Another subject of the invention is a process for reducing the fuel consumption of a vehicle, said process comprising a step of bringing a lubricant composition as defined above into contact with at least one mechanical part of the engine of said vehicle. In an embodiment, the vehicle is a light vehicle, a heavy goods vehicle or a ship.

DETAILED DESCRIPTION

Glycerol Esters

Surprisingly, the applicant has demonstrated that the use of at least two chemically different glycerol esters, one of the esters being obtained from a "long chain" carboxylic acid and the other being obtained from a "short chain" carboxylic acid, makes it possible to formulate lubricant compositions in particular for engines having very good Fuel Eco performance. The esters used are glycerol esters. The first ester $E_1$ is an ester of glycerol and of a $C_{12}$ to $C_{26}$ carboxylic acid, and the second ester $E_2$ is an ester of glycerol and of a $C_4$ to $C_{10}$ carboxylic acid. The first ester $E_1$ is an ester of glycerol and of a $C_{12}$ to $C_{26}$, preferably $C_{14}$ to $C_{24}$, more preferably $C_{16}$ to $C_{22}$, even more preferably $C_{18}$ to $C_{20}$ carboxylic acid. Preferably, glycerol ester $E_1$ is an ester of glycerol and of a $C_{12}$ to $C_{26}$ carboxylic acid, the hydrocarbon chain of the carboxylic acid comprising at least two unsaturations. The first ester $E_1$ is an ester of glycerol and of a $C_{12}$ to $C_{26}$, preferably $C_{14}$ to $C_{24}$, more preferably $C_{16}$ to $C_{22}$, even more preferably $C_{18}$ to $C_{20}$ fatty acid.

By "fatty acid" is meant, within the meaning of the present invention, a carboxylic acid comprising from 12 to 16 carbon atoms, preferably from 14 to 24 carbon atoms, more preferably from 16 to 22 carbon atoms, even more preferably from 18 to 20 carbon atoms. The fatty acids used for preparing glycerol ester $E_1$ are saturated or unsaturated, linear or branched fatty acids optionally substituted with hydroxyl and/or epoxide groups. Advantageously, glycerol ester $E_1$ is obtained from raw materials of renewable origin.

By "raw materials of renewable origin" is meant, within the meaning of the present invention, raw materials that contain carbon 14, denoted $^{14}C$, in contrast to the raw materials derived from fossil material. Measurements carried out by the methods described in the international standard ASTM D6866-06, in particular by mass spectrometry or by liquid scintillation spectrometry, thus make it possible to distinguish raw materials originating from renewable material from raw materials of fossil origin. These measurements can be used as a test for identifying the origin of raw materials.

The fatty acids that can be used for forming the first glycerol ester $E_1$ are for example the following fatty acids used alone or in a mixture: lauric acid, myristic acid, pentadecyl acid, palmitic acid, margaric acid, stearic acid, arachidic acid, behenic acid, lignoceric acid, cerotic acid, isopalmitic acid, isomargaric acid, ante-isomargaric acid, isostearic acid, ante-isostearic acid, hypogaeic acid, palmitoleic acid, oleic acid, elaidic acid, vaccenic acid, petroselinic acid, gadoleic acid, gondoic acid, ketoleic acid, erucic acid, brassidic acid, nervonic acid, linoleic acid, hiragonic acid, linolenic acid, γ-linolenic acid, eleostearic acid, parinaric acid, homo-γ-linolenic acid, arachidonic acid, clupanodonic acid, tariric acid, santalbic acid or xymenic acid, isanic acid, dihydroxystearic acid, phellonic acid, cerebronic acid, ricinoleic acid, lesquerolic acid, hydroxynervonic acid, densipolic acid, kamlonenic acid, licanic acid, vernolic acid, coronaric acid. These various fatty acids can be found in the following vegetable oils, fats of animal or vegetable origin, and waxes: beeswax, almond oil, peanut oil, babassu oil, spermaceti, baobab oil, butterfat, tung oil, cocoa butter, camelina oil, carnauba wax, safflower oil, chaulmoogra oil, horse fat, colza oil, copra oil, cottonseed oil, croton oil, herring oil, illipe butter, jojoba oil, shea butter, lanolin, lignite wax, linseed oil, maize germ oil, menhaden oil, cod liver oil, mustard oil, hazelnut oil, walnut oil, new colza oil, kernel oil, carnation oil, goose fat, oiticica oil, olive oil, evening primrose oil, bone fat, palm oil, cabbage palm oil, grapeseed oil, neatsfoot oil, shark liver oil, castor oil, rice bran oil, lard, sardine oil, sesame oil, soya oil, spermaceti, tallow, sunflower oil, tall oil etc.

The preferred oils are palm oil, olive oil, peanut oil, colza oil, sunflower oil, soya oil, maize oil, safflower oil, camelina oil, flax oil or cottonseed oil. More preferably the oils are peanut oil, colza oil, sunflower oil, soya oil, maize oil, safflower oil, camelina oil, flax oil or cottonseed oil. Even more preferably the oils are sunflower oil, soya oil, maize oil, safflower oil or cottonseed oil. The preferred oils comprise a non-negligible quantity of linoleic acid, i.e. they comprise from 25 to 85% by mass of linoleic acid relative to the total mass of fatty acids of the oils, preferably from 35 to 75%, preferably from 45 to 65%.

The glycerol esters $E_1$ according to the invention are advantageously mixtures of glycerol monoesters, glycerol diesters, glycerol triesters and free glycerol. Preferably, the glycerol esters $E_1$ according to the invention comprise from 0.1 to 15% by mass of free glycerol, relative to the total mass of the glycerol esters, more preferably from 0.5 to 10%, even more preferably from 1 to 5%. Preferably, the glycerol esters $E_1$ according to the invention comprise from 30 to 70% by mass of glycerol monoester, relative to the total mass of the glycerol esters, more preferably from 40 to 60%, even more preferably from 45 to 55%. Preferably, the glycerol esters $E_1$ according to the invention comprise from 20 to 60% by mass of glycerol diester, relative to the total mass of the glycerol esters, more preferably from 30 to 50%, even more preferably from 35 to 45%. Preferably, the glycerol esters $E_1$ according to the invention comprise from 1 to 20% by mass of glycerol triester, relative to the total mass of the glycerol esters, more preferably from 2 to 15%, even more preferably from 5 to 10%.

The glycerol esters $E_1$ are obtained by esterification of glycerol and fatty acids or by transesterification. These chemical reactions, well known to a person skilled in the art, can take place with or without catalyst, with or without solvent. The other glycerol ester denoted $E_2$ is an ester of glycerol and a $C_4$ to $C_{10}$, preferably $C_5$ to $C_9$, more preferably $C_6$ to $C_8$, more preferably $C_7$ carboxylic acid.

By "short chain or short-chain" carboxylic acid is meant, within the meaning of the present invention, a carboxylic acid comprising from 4 to 10 carbon atoms, preferably from 5 to 9 carbon atoms, preferably from 6 to 8 carbon atoms, preferably with 7 carbon atoms. The carboxylic acids used for preparing glycerol ester $E_2$ are saturated or unsaturated, linear or branched carboxylic acids, optionally substituted with hydroxyl and/or epoxide groups. In an embodiment, glycerol ester $E_2$ is obtained from raw materials of renewable origin.

The carboxylic acids that can be used for forming the second glycerol ester $E_2$ are for example carboxylic acids originating from vegetable oils, fats of animal or vegetable origin such as butyric acid, valeric acid, caproic acid, heptylic acid, caprylic acid, pelargonic acid, capric acid, crotonic acid, isocrotonic acid, sorbic acid, isovaleric acid, used alone or in a mixture. In another embodiment, glycerol ester $E_2$ is obtained from raw materials of fossil origin. The term synthetic carboxylic acids is then used. It is also possible to use synthetic carboxylic acids such as butanoic acid, pentanoic acid, hexanoic acid, heptanoic acid, octanoic acid, nonanoic acid, decanoic acid, used alone or in a mixture.

The glycerol esters $E_2$ according to the invention are advantageously mixtures of glycerol monoesters, glycerol diesters, glycerol triesters and free glycerol. Preferably, the glycerol esters $E_2$ according to the invention comprise from 0.1 to 20% by mass of free glycerol, relative to the total mass of the glycerol esters, more preferably from 0.5 to 15%, even more preferably from 1 to 10%. Preferably, the glycerol esters $E_2$ according to the invention comprise from 30 to 70% by mass of glycerol monoester, relative to the total mass of the glycerol esters, more preferably from 40 to 60%, even more preferably from 45 to 55%. Preferably, the glycerol esters $E_2$ according to the invention comprise from 20 to 60% by mass of glycerol diester, relative to the total mass of the glycerol esters, more preferably from 30 to 50%, even more preferably from 35 to 45%. Preferably, the glycerol esters $E_2$ according to the invention comprise from 1 to 15% by mass of glycerol triester, relative to the total mass of the glycerol esters, more preferably from 2 to 10%, even more preferably from 5 to 8%.

The glycerol esters $E_2$ are obtained by reacting $C_4$ to $C_{10}$ carboxylic acids with glycerol. These chemical reactions, well known to a person skilled in the art, can take place with or without catalyst, with or without solvent.

In the composition according to the invention, the sum of the mass of glycerol ester $E_1$ and the mass of glycerol ester $E_2$, in their monoester, diester and triester forms, as well as glycerol optionally present, represents from 0.1 to 5% by mass, relative to the total mass of the lubricant composition, preferably from 0.2 to 4%, more preferably from 0.5 to 3%, even more preferably from 1 to 2%. The mass ratio of glycerol ester $E_1$ to glycerol ester $E_2$, in their monoester, diester, and triester forms as well as glycerol optionally present, is between 10:1 and 1:10, preferably between 5:1 and 1:5, more preferably between 2:1 and 1:2, even more preferably is equal to 1:1.

Level of Ash

Preferably, the lubricant composition according to the invention is a so-called low-ash composition (LOW SAPS). By the term "low ash" (LOW SAPS) is meant lubricants specifically formulated to meet certain specifications. These specifications, prepared by the European Automobile Manufacturers Association (ACEA), require lubricant compositions to meet limits for content of sulphated ash (generated by the presence of metals), of sulphur and of phosphorus, hence the designation "Low SAPS" for "Sulphated Ash, Phosphorus, Sulphur". In the remainder of the present application, the terms "ash" or "sulphated ash" will be used interchangeably.

In fact sulphur, phosphorus and sulphated ash can damage the post-treatment systems installed on vehicles. The ash is harmful to the particle filters and phosphorus acts as a poison of the catalytic systems.

Preferably, the lubricant composition according to the invention has a level of sulphated ash less than or equal to 0.8% by mass measured according to the international standard ASTM D874, more preferably less than or equal to 0.5% by mass. Preferably, the lubricant composition according to the invention has a level of phosphorus less than or equal to 900 ppm measured according to the international standard ASTM D5185, more preferably less than or equal to 500 ppm (ppm means parts per million by mass). Preferably, the lubricant composition according to the invention has a level of sulphur below 0.32% measured according to the international standard ASTM D5185, more preferably less than or equal to 0.3%, even more preferably less than or equal to 0.2%.

Base Oils

The lubricant compositions according to the present invention comprise one or more base oils, generally representing at least 50% by mass of the lubricant compositions, generally more than 70% and being able to be up to 90% or more, relative to the total mass of the lubricant compositions. The base oil or oils used in the lubricant compositions according to the present invention can be oils of mineral or synthetic origin of groups I to V according to the classes defined in the API classification (American Petroleum Institute (or their equivalents according to the ATIEL classification (Association Technique de l'Industrie Européenne des Lubrifiants—Technical Association of the European Lubricants Industry)) as summarized below, alone or in a mixture.

| | Saturates content | Sulphur content | Viscosity index (VI) |
|---|---|---|---|
| Group I Mineral oils | <90% | >0.03% | 80 ≤ VI < 120 |
| Group II Hydrocracked oils | ≥90% | ≤0.03% | 80 ≤ VI < 120 |
| Group III Hydrocracked or hydro-isomerized oils | ≥90% | ≤0.03% | ≥120 |
| Group IV | (PAO) Polyalphaolefins | | |
| Group V | Esters and other bases not included in bases of groups I to IV | | |

These oils can be oils of vegetable, animal, or mineral origin. The mineral base oils according to the invention include all types of bases obtained by atmospheric and vacuum distillation of crude oil, followed by refining operations such as solvent extraction, deasphalting, solvent dewaxing, hydrotreatment, hydrocracking and hydroisomerization, hydrofinishing. The base oils of the lubricant compositions according to the present invention can also be synthetic oils, such as certain esters of carboxylic acids and alcohols, or polyalphaolefins. The polyalphaolefins used as base oils, and which are different from the heavy polyalphaolefins also present in the compositions according to the present invention, are for example obtained from monomers having from 4 to 32 carbon atoms (for example octene, decene), and a viscosity at 100° C. between 1.5 and 15 cSt measured according to the international standard ASTM D445. Their mass-average molecular mass is typically between 250 and 3000 g/mol measured according to the international standard ASTM D5296. Mixtures of synthetic and mineral oils can also be used.

Preferably, the compositions according to the present invention have a kinematic viscosity at 100° C. (KV100) between 3.8 and 41 cSt measured according to the international standard ASTM D445, preferably between 3.8 and 32.5 cSt, even more preferably between 3.8 and 24 cSt. Preferably, it will advantageously be possible to use base oils having a sulphur content below 0.3% for example mineral oils of group III, and synthetic bases free from sulphur, preferably of group IV, or a mixture thereof. Thus, the lubricant composition according to the present invention can contain at least 70% of base oil, typically at least 60% by mass of one or more group III base oils and at least 10% by mass of one or more group IV base oils, relative to the total mass of the lubricant composition.

In a preferred embodiment, the composition according to the invention is an engine oil having a kinematic viscosity at 100° C. (KV100), measured according to the international standard ASTM D445, between 3.8 cSt and 26.1 cSt, preferably between 4.1 cSt and 21.9 cSt, preferably between 5.6 cSt and 16.3 cSt. The engine oils according to the invention are of grade 20, 30 and 40 according to the SAE J300 classification, preferably of grade 30 or of grade 40. According to an especially preferred embodiment, the compositions according to the present invention are of grade 5W-30 according to the SAE J300 classification (SAE stands for Society of Automotive Engineers).

The engine oils according to the present invention preferably have a viscosity index VI greater than or equal to 130, preferably greater than or equal to 150, preferably greater than or equal to 160. In another embodiment, the lubricant composition according to the invention is a transmission oil, preferably a gearbox oil, having a kinematic viscosity at 100° C. measured according to the standard ASTM D445, between 4.1 cSt and 41 cSt, preferably between 4.1 cSt and 32.5 cSt, preferably between 4.1 cSt and 24 cSt, preferably between 4.1 cSt and 18.5 cSt. The transmission oils according to the invention are of grade 75W, 80W, 85W, 80, 85 and 90 according to the SAE J306 classification.

Other Additives

The composition according to the invention can further comprise at least one additive or several additives as described below. The additive or additives that are added are selected depending on the use of the lubricant composition. These additives can be introduced separately and/or included in additive packages used in the formulations of lubricant compositions in particular for engines. Thus, the lubricant compositions according to the invention can in particular and non-limitatively contain anti-wear and extreme pressure additives, antioxidants, detergents that are overbased or not, polymers improving the viscosity index, pour point improvers, dispersants, anti-foaming agents, thickeners etc.

The anti-wear and extreme pressure additives protect friction surfaces by the formation of a protective film adsorbed on these surfaces. There is a great variety of anti-wear additives, but the category most used in lubricant compositions in particular for engines is that of the phosphorus- and sulphur-containing additives such as the metal alkylthiophosphates, in particular the zinc alkylthiophosphates, and more specifically the zinc dialkyldithiophosphates or ZnDTP. The preferred compounds are of formula $Zn((SP(S)(OR_1)(OR_2))_2$, where $R_1$ and $R_2$ are alkyl groups, preferably comprising from 1 to 18 carbon atoms.

The amine phosphates are also commonly used anti-wear additives. However, the phosphorus supplied by these additives acts as a poison of automotive catalytic systems, and they also supply ash. These effects can be minimized by partially substituting with additives that do not supply phosphorus, such as for example the polysulphides, in particular the sulphur-containing olefins.

Anti-wear and extreme pressure additives of the nitrogen-containing and sulphur-containing type, for example the metal dithiocarbamates, in particular molybdenum dithiocarbamate, which also generate ash, are also usually found in the lubricant compositions. The anti-wear and extreme-pressure additives are present in the lubricant compositions according to the invention in contents between 0.01 and 6% by mass, preferably between 0.05 and 4%, more preferably between 0.1 and 2%, relative to the mass of the lubricant compositions.

Friction modifiers can optionally be added to the lubricant compositions comprising at least two glycerol esters $E_1$ and $E_2$. These friction modifiers optionally added to the lubricant compositions in particular for four-stroke engines can be compounds supplying metal elements or ash-free compounds. There can also be solid compounds such as molybdenum disulphide, graphite or polytetrafluoroethylene (PTFE).

The metal compounds are for example complexes of transition metals such as Mo, Sb, Sn, Fe, Cu, Zn, the ligands of which can be hydrocarbon compounds containing oxygen, nitrogen, sulphur or phosphorus atoms. In particular, the compounds containing molybdenum can be particularly effective, such as for example the molybdenum dithiocarbamates or dithiophosphates.

The ash-free friction modifiers can be for example fatty alcohols, fatty acids, esters, fatty amines. These friction modifying additives, optionally added, are present in contents between 0.01 and 5% by mass relative to the total mass of the lubricant composition, preferably 0.1 and 2%. By combining two glycerol esters $E_1$ and $E_2$, it is possible to formulate lubricant compositions which have, advantageously during the phase of engine starting, improved friction properties relative to the lubricant compositions comprising Mo-DTC. These friction modifiers $E_1$ and $E_2$ have the advantage of being additives that do not supply sulphated ash, phosphorus and sulphur.

In an embodiment, the lubricant composition according to the invention can in addition to the glycerol esters $E_1$ and $E_2$ further comprise other friction modifiers, but the quantity thereof will be limited. In an embodiment of the invention, the quantity of friction modifiers other than the two glycerol esters $E_1$ and $E_2$ is less than or equal to 2% by mass, relative to the total mass of the lubricant composition, more preferably less than or equal to 1% by mass, even more preferably less than or equal to 0.5% by mass, even more preferably less than or equal to 0.1% by mass. Preferably, the quantity of friction modifiers supplying ash, such as the molybdenum-based friction modifiers, such as MoDTC, is less than or equal to 2% by mass, relative to the total mass of the lubricant composition, more preferably less than or equal to 1% by mass, even more preferably less than or equal to 0.5% by mass, even more preferably less than or equal to 0.1% by mass. In another embodiment of the invention, the lubricant compositions according to the present invention are devoid of friction modifiers supplying ash, for example the molybdenum-based friction modifiers, such as MoDTC.

The antioxidants slow down the degradation of the oils in service; degradation which can result in the formation of deposits, the presence of sludge, or an increase in the viscosity of the oil. They act as radical inhibitors or hydroperoxide destroyers. The antioxidants commonly used include the antioxidants of the phenolic or amino type. Some of these additives, for example the phosphorus- and sulphur-containing antioxidants, may generate ash.

The phenolic antioxidants may be ash-free, or be in the form of neutral or basic metal salts. Typically, they are compounds containing a sterically hindered hydroxyl group, for example when two hydroxyl groups are in the ortho or para position relative to one another, or when the phenol is substituted with an alkyl group comprising at least 6 carbon atoms.

The amino compounds are another class of antioxidants that can be used, optionally in combination with the phenolic antioxidants. Typical examples are the aromatic amines, of formula $R_8R_9R_{10}N$, where $R_8$ is an aliphatic group, or an optionally substituted aromatic group, $R_9$ is an optionally substituted aromatic group, $R_{10}$ is hydrogen, or an alkyl or aryl group, or a group of formula $R_{11}S(O)_xR_{12}$, where $R_{11}$ and/or $R_{12}$ is an alkylene, alkenylene, or aralkylene group, and x is an integer equal to 0, 1 or 2. Sulphurized alkyl phenols or their alkali-metal and alkaline-earth salts are also used as antioxidants.

Another class of antioxidants is that of the oil-soluble copper compounds, for example the copper thio- or dithiophosphates, the salts of copper and carboxylic acids, the copper dithiocarbamates, sulphonates, phenates, and acetylacetonates. The copper I and II salts of succinic acid or anhydride are used. The antioxidants, alone or in a mixture, are typically present in the lubricant compositions according to the invention in quantities comprised between 0.1 and 5% by mass, relative to the total mass of the lubricant compositions. The lubricant compositions according to the present invention can contain all types of antioxidant additives known to a person skilled in the art. The ash-free antioxidants will be preferred.

The detergents reduce the formation of deposits on the surface of metal parts by dissolving the by-products of oxidation and combustion. The detergents that can be used in the lubricant compositions according to the present invention are familiar to a person skilled in the art. The detergents commonly used in the formulation of lubricant compositions are typically anionic compounds comprising a long lipophilic hydrocarbon chain and a hydrophilic head. The associated cation is typically a metal cation of an alkali or alkaline-earth metal.

The detergents are preferably selected from the alkali- or alkaline-earth metal salts of carboxylic acids, sulphonates, salicylates, naphthenates, as well as the salts of phenate. The alkali and alkaline-earth metals are preferably calcium, magnesium, sodium or barium. These metal salts can contain the metal in an approximately stoichiometric quantity or in excess (in a quantity greater than the stoichiometric quantity). In the latter case, these detergents are referred to as overbased detergents. The excess metal providing the detergent with its overbased character is present in the form of metal salts which are insoluble in oil, for example carbonate, hydroxide, oxalate, acetate, glutamate, preferably carbonate.

The viscosity index improving polymers make it possible to guarantee good low-temperature stability and minimum viscosity at high temperature, in particular for formulating multigrade oils. Addition of these compounds to the lubricant compositions allows them to reach viscosity index (VI) values giving them good Fuel Eco properties or fuel savings. Thus, preferably, the viscosity index (VI) of the lubricant compositions according to the invention, measured according to the international standard ASTM D2270, is greater than or equal to 130, preferably greater than or equal to 150, preferably greater than or equal to 160.

Among these compounds, the polymer esters, the copolymer olefins (CPO), the homopolymers or copolymers of styrene, butadiene or isoprene, hydrogenated or not, and the polymethacrylates (PMA) may for example be mentioned. The lubricant compositions according to the present invention can contain of the order of 0.1 to 10% by mass of viscosity index improving polymers, relative to the total mass of the lubricant compositions, preferably from 0.5 to 5%, preferably from 1 to 2%.

The pour point depressants improve the low-temperature behaviour of the oils, by slowing the formation of paraffin crystals. These are for example alkyl polymethacrylates, polyacrylates, polyarylamides, polyalkylphenols, polyalkylnaphthalenes, alkylated polystyrenes etc.

The dispersants, such as for example succinimides, PIB (polyisobutene) succinimides, Mannich bases, ensure maintenance in suspension and the removal of insoluble solid impurities constituted by the oxidation by-products that form when a lubricant composition is in service.

The Surfaces

The lubricant compositions according to the invention can be used for lubricating the surfaces of the parts that are conventionally found in an engine such as the system of pistons, rings, liners. They can also be used for lubricating transmission systems such as manual or automatic gearboxes. The lubricant compositions according to the invention can be used in light vehicles, heavy goods vehicles, but also in ships.

Another subject of the present invention is a process for the lubrication of at least one mechanical part of an engine, said process comprising a step in which said mechanical part is brought into contact with at least one lubricant composition as defined above. In an embodiment, the mechanical part is selected from the group comprising the system of pistons, rings, liners. In another embodiment, the mechanical part forms a mechanical component such as transmission systems, preferably manual gearboxes or automatic gearboxes.

Another subject of the invention is a process for reducing the fuel consumption of a vehicle, said process comprising a step of bringing a lubricant composition as defined above into contact with at least one mechanical part of the engine of said vehicle. In an embodiment, the vehicle is a light vehicle, a heavy goods vehicle or a ship.

EXAMPLE 1

A control lubricant composition T not comprising friction modifiers is prepared from:

a group III base oil having a kinematic viscosity at 100° C. (KV100) equal to 6 cSt (measured according to the international standard ASTM D445), a group III base oil having a kinematic viscosity at 100° C. (KV100) equal to 4 cSt (measured according to the international standard ASTM D445), a light polyalphaolefin (PAO), group IV base oil having a kinematic viscosity at 100° C. (KV100) equal to 6 cSt (measured according to the international standard ASTM D445), a linear ethylene/propylene olefin copolymer (OCP), comprising 50% by mass of ethylene, relative to the mass of the copolymer, having a weight average molecular mass Mw equal to 171,700 g/mol (measured according to the international standard ASTM D5296) and a number average molecular mass Mn equal to 91,120 g/mol (measured according to the international standard ASTM D5296), a heavy PAO having a kinematic viscosity at 100° C. (KV100) equal to 1000 cSt (measured according to the international standard ASTM D445), a pour point depressant (PPD) which is a polymethacrylate, an additive package comprising slightly and highly overbased detergents, phenolic and amine antioxidants, a dispersant of the succinimide type, an anti-wear additive based on amine phosphate and zinc dialkyl dithiophosphate (Zn DTP).

The percentages by mass of the different constituents are given in Table I below, as well as the properties of this control lubricant composition.

(1) measured according to the international standard ASTM D5185

(2) measured according to the international standard ASTM D5185

(3) measured according to the international standard ASTM D874

(4) measured according to the international standard ASTM D2896

(5) measured according to the international standard ASTM D445

(6) measured according to the international standard ASTM D445

TABLE I

| | Control composition T |
|---|---|
| Mixture of group III base oils, % by mass | 65.6 |
| Light PAO, % by mass | 15.2 |
| OCP, % by mass | 2.2 |
| Heavy PAO, % by mass | 3.0 |
| PPD, % by mass | 0.2 |
| Additive package, % by mass | 13.8 |
| Total, % by mass | 100 |
| Phosphorus, ppm, (1) | 501 |
| Sulphur, ppm, (2) | 1346 |
| Sulphated ash, % by mass, (3) | 0.5 |
| TBN (Total Base Number), mg KOH/g, (4) | 5.95 |
| KV100, cSt, (5) | 9.94 |
| KV40, cSt, (6) | 57.81 |
| Viscosity index | 159 |

Various friction modifiers are added to this composition:

Glycerol monooleate (GMO) marketed by Stéarinerie Dubois under the name DUB OG.

Glycerol linoleate comprising 45% by mass of monoester, relative to the total mass of glycerol linoleate, 40% by mass of diesters, 10% by mass of triesters, 5% by mass of free glycerol. This glycerol linoleate is obtained from a mixture of fatty acids, with the linoleic acid representing 75 to 80% by mass of the total mass of the fatty acids, the remainder being constituted by:

myristic acid (less than 1% of the total mass of the fatty acids), palmitic acid (5 to 8% of the total mass of the fatty acids), stearic acid (2 to 3% of the total mass of the fatty acids), oleic acid (11 to 15% of the total mass of the fatty acids), linolenic acid (less than 2% of the total mass of the fatty acids), arachidic acid (less than 1% of the total mass of the fatty acids) and gadoleic acid (less than 1% of the total mass of the fatty acids).

This ester is marketed by Stéarinerie Dubois under the name DUB LIG.

Glycerol heptanoate, comprising 47% by mass of monoester, relative to the total mass of glycerol heptanoate, 36% by mass of diesters, 6% by mass of triesters, 11% by mass of free glycerol. This ester is obtained from heptanoic acid.

a pentaerythritol ester, as described in the application WO2010064220 having the following characteristics: n1=73.2%, n2=26.8%, KV100=4.657 cSt, KV40=18.50 cSt, with viscosity index=183.

molybdenum dithiocarbamate marketed under the name Sakura-lube 525 by the company Adeka.

The composition $C_7$ illustrates a composition comprising Mo-DTC, the level of treatment of which is usually in the lubricant compositions available on the market with 400 ppm by mass of Mo-DTC. The percentages by mass of the resultant compositions are given in Table II below.

TABLE II

| | $C_1$ | $C_2$ | $C_3$ | $C_4$ | $C_5$ | $C_6$ | $C_7$ |
|---|---|---|---|---|---|---|---|
| Control composition T | 99% | 99% | 99% | 98% | 99% | 99% | 99.6% |
| Glycerol monooleate | 1% | — | — | — | — | — | — |
| Glycerol linoleate | — | 1% | — | 1% | 0.5% | — | — |
| Glycerol heptanoate | — | — | 1% | 1% | 0.5% | — | — |

TABLE II-continued

| | $C_1$ | $C_2$ | $C_3$ | $C_4$ | $C_5$ | $C_6$ | $C_7$ |
|---|---|---|---|---|---|---|---|
| Pentaerythritol ester | — | — | — | — | — | 1% | — |
| Molybdenum dithiocarbamate (Mo-DTC) | | | | | | | 0.4% |

The physicochemical characteristics of the resultant compositions are given in Table III below.

TABLE III

| | $C_1$ | $C_2$ | $C_3$ | $C_4$ | $C_5$ | $C_6$ | $C_7$ |
|---|---|---|---|---|---|---|---|
| KV100, cSt, (5) | 10.07 | 10.07 | 10.02 | 10.05 | 10.04 | 10.11 | 10.08 |
| KV40, cSt, (6) | 57.59 | 57.53 | 57.76 | 57.76 | 57.66 | 57.29 | 57.54 |
| Sulphated ash, % by mass, (3) | 0.5 | 0.5 | 0.5 | 0.5 | 0.5 | 0.5 | >0.5 |
| Sulphur, ppm, (2) | 1346 | 1346 | 1346 | 1346 | 1346 | 1346 | >1346 |
| Phosphorus, ppm, (1) | 501 | 501 | 501 | 501 | 501 | 501 | >501 |

(1) measured according to the international standard ASTM D5185
(2) measured according to the international standard ASTM D5185
(3) measured according to the international standard ASTM D874
(5) measured according to the international standard ASTM D445
(6) measured according to the international standard ASTM D445

Then the friction coefficient of the compositions is measured by a Cameron Plint Friction laboratory test using a reciprocating tribometer of the Cameron-Plint TE-77 type. The test bench consists of a cylinder-on-flat tribometer immersed in the oil to be tested. A variable normal force is applied to the heated flat and the resultant frictional force is measured. The conditions of temperature, load and frequency are varied. The values of the friction coefficient, obtained at different temperatures, loads and frequencies, are shown in Table IV as well as the overall mean value of these six different phases.

TABLE IV

| | T | $C_1$ | $C_2$ | $C_3$ | $C_4$ | $C_5$ | $C_6$ | $C_7$ |
|---|---|---|---|---|---|---|---|---|
| mean friction coefficient (55N, 100° C., 40 Hz) | 0.127 | 0.145 | 0.142 | 0.075 | 0.062 | 0.062 | 0.083 | 0.086 |
| mean friction coefficient (155N, 100° C., 40 Hz) | 0.125 | 0.106 | 0.104 | 0.062 | 0.038 | 0.049 | 0.095 | 0.058 |
| mean friction coefficient (255N, 100° C., 40 Hz) | 0.137 | 0.111 | 0.096 | 0.070 | 0.052 | 0.058 | 0.109 | 0.057 |
| mean friction coefficient (255N, 150° C., 5 Hz) | 0.165 | 0.123 | 0.118 | 0.162 | 0.097 | 0.146 | 0.132 | 0.097 |
| mean friction coefficient (255N, 150° C., 20 Hz) | 0.160 | 0.120 | 0.105 | 0.155 | 0.103 | 0.143 | 0.128 | 0.098 |
| mean friction coefficient (255N, 150° C., 40 Hz) | 0.148 | 0.127 | 0.102 | 0.146 | 0.092 | 0.131 | 0.121 | 0.074 |
| overall mean friction coefficient | 0.144 | 0.122 | 0.111 | 0.112 | 0.074 | 0.098 | 0.111 | 0.080 |

It can be seen that the addition of 1% of GMO makes it possible to reduce the overall mean friction coefficient (for all 6 phases) of the lubricant composition. The same applies to the addition of 1% of glycerol linoleate or 1% of glycerol heptanoate. At 2% of active ingredient, composition $C_4$ has the lowest friction coefficient of the lubricant compositions T, $C_1$ to $C_6$. At 1% by mass of active substance, lubricant composition $C_5$ based on the mixture of long chain/short chain glycerol esters has a lower overall friction coefficient than lubricant compositions T, $C_1$ to $C_3$ and $C_6$ based on other compounds also at 1% by mass of active substance. Compositions $C_4$ and $C_5$ make it possible to obtain a lower friction coefficient than the compositions comprising Mo-DTC (composition $C_7$) during the engine starting phases (i.e. n the case of temperatures of 100° C.).

EXAMPLE 2

The objective of this example is to show the influence of the presence of unsaturations in the $C_{12}$ to $C_{26}$ carboxylic acid of ester $E_1$ according to the invention on the friction properties of the lubricant composition. For this, compositions $C_8$ and $C_9$ are prepared by adding the following friction modifiers to the control composition of example 1:

- glycerol monoisostearate marketed by Stéarinerie Dubois under the name DUB ISG and obtained from a saturated $C_{18}$ carboxylic acid,
- glycerol monooleate marketed by Stéarinerie Dubois under the name DUB OG and obtained from an unsaturated $C_{18}$ carboxylic acid comprising one unsaturation. The glycerol monooleate comprises 32-52% by mass of monoester, relative to the total mass of glycerol monooleate, 30-50% by mass of diesters, 5-20% by mass of triesters, at most 6% by mass of free glycerol.
- glycerol linoleate obtained from an unsaturated $C_{18}$ carboxylic acid comprising two unsaturations, its composition is described in Example 1.
- glycerol heptanoate: its composition is described in Example 1.

The percentages by mass of the resultant compositions are given in Table V below.

TABLE V

| | $C_5$ | $C_8$ | $C_9$ |
|---|---|---|---|
| Control composition T | 99% | 99% | 99% |
| Glycerol monoisostearate | | 0.5% | |
| Glycerol monooleate | | | 0.5% |
| Glycerol linoleate | 0.5% | | |
| Glycerol heptanoate | 0.5% | 0.5% | 0.5% |

Then the friction coefficient of the compositions is measured by a Cameron Plint Friction laboratory test using an reciprocating tribometer of the Cameron-Plint TE-77 type under the conditions described in Example 1. The results obtained are presented in Table VI.

TABLE VI

| | $C_5$ | $C_8$ | $C_9$ |
|---|---|---|---|
| Overall mean friction coefficient | 0.098 | 0.110 | 0.112 |

The results show that the selection of an unsaturated $C_{12}$ to $C_{26}$ carboxylic acid comprising at least two unsaturations in order to form ester $E_1$ according to the invention allows an even more significant reduction in the overall mean friction coefficient, relative to a saturated $C_{12}$ to $C_{26}$ carboxylic acid or an unsaturated $C_{12}$ to $C_{26}$ carboxylic acid comprising a single unsaturation.

The invention claimed is:

1. A lubricant composition comprising at least one base oil and at least two glycerol esters $E_1$ and $E_2$, glycerol ester $E_1$ being selected from glycerol linoleates and mixtures thereof, glycerol ester $E_2$ being selected from glycerol heptanoates and mixtures thereof, the ester $E_1$ is a mixture of glycerol monoesters, glycerol diesters, glycerol triesters and free glycerol and the ester $E_2$ is a mixture of glycerol monoesters, glycerol diesters, glycerol triesters and free glycerol, the sum of the masses of the glycerol esters $E_1$ and $E_2$ represents 0.5 to 2% by mass, relative to the total mass of the lubricant composition, and the mass ratio of the glycerol ester $E_1$ and the glycerol ester $E_2$ is between 10:1 and 1:10.

2. The lubricant composition according to claim 1, having a level of sulphated ash less than or equal to 0.8% measured according to the standard ASTM D874.

3. The lubricant composition according to claim 1, having a level of phosphorus less than or equal to 900 ppm measured according to the standard ASTM D5185.

4. The lubricant composition according to claim 1, having a level of sulphur less than or equal to 0.32% measured according to the standard ASTM D5185.

5. The lubricant composition according to claim 1, having a kinematic viscosity at 100° C. measured according to the standard ASTM D445 between 3.8 and 41 cSt.

6. The lubricant composition according to claim 1, being free from molybdenum-based friction modifying additive such as Mo-DTC.

7. A process for reducing the fuel consumption of a light vehicle, heavy goods vehicle or vehicle, the process comprising a step of bringing a lubricant composition into contact with at least one mechanical part of an engine of the vehicle, the lubricating composition comprising at least one base oil and at least two glycerol esters $E_1$ and $E_2$, glycerol ester $E_1$ being selected from glycerol linoleates and mixtures thereof, glycerol ester $E_2$ being selected from glycerol heptanoates and mixtures thereof, the ester $E_1$ being a mixture of glycerol monoesters, glycerol diesters, glycerol triesters and free glycerol and the ester $E_2$ being a mixture of glycerol monoesters, glycerol diesters, glycerol triesters and free glycerol, the sum of the masses of the glycerol esters $E_1$ and $E_2$ represents 0.5 to 2% by mass, relative to the total mass of the lubricant composition, and the mass ratio of the glycerol ester $E_1$ and the glycerol ester $E_2$ is between 10:1 and 1:10.

8. An engine oil comprising at least one lubricant composition as defined in claim 1.

9. The engine oil according to claim 8 that is of grade 5W-30 according to the SAE J300 classification.

10. The engine oil according to claim 8 having a viscosity index greater than or equal to 130.

11. A hydraulic oil, transmission oil, gear oil, power steering fluid, shock absorber fluid, brake fluid comprising at least one lubricant composition as defined in claim 1.

12. A method of at least two glycerol esters $E_1$ and $E_2$, in a base oil, the ester $E_1$ being selected from glycerol linoleates and mixtures thereof, the ester $E_2$ being selected from glycerol heptanoates and mixtures thereof, the method comprising reducing fuel consumption of light vehicles, heavy goods vehicles or ships, the ester $E_1$ being a mixture of glycerol monoesters, glycerol diesters, glycerol triesters and free glycerol and the ester $E_2$ being a mixture of glycerol monoesters, glycerol diesters, glycerol triesters and free glycerol, the sum of the masses of the glycerol esters $E_1$ and $E_2$ represents 0.5 to 2% by mass, relative to the total mass of the lubricant composition, and the mass ratio of the glycerol ester $E_1$ and the glycerol ester $E_2$ is between 10:1 and 1:10.

13. A process for lubricating at least one mechanical part of an engine, the process comprising a step in which the mechanical part is brought into contact with at least one lubricant composition, the lubricating composition comprising at least one base oil and at least two glycerol esters $E_1$ and $E_2$, glycerol ester $E_1$ being selected from glycerol linoleates and mixtures thereof, glycerol ester $E_2$ being selected from glycerol heptanoates and mixtures thereof, the ester $E_1$ being a mixture of glycerol monoesters, glycerol diesters, glycerol triesters and free glycerol and the ester $E_2$ being a mixture of glycerol monoesters, glycerol diesters, glycerol triesters and free glycerol, the sum of the masses of the glycerol esters $E_1$ and $E_2$ represents 0.5 to 2% by mass, relative to the total mass of the lubricant composition, and the mass ratio of the glycerol ester $E_1$ and the glycerol ester $E_2$ is between 10:1 and 1:10.

14. The lubricant composition according to claim 1, wherein the glycerol ester $E_1$ comprises glycerol linoleate and the glycerol ester $E_2$ comprises glycerol heptanoate, the glycerol linoleate having a concentration of 1% by mass relative to the total mass of the lubricant composition, and the glycerol heptanoate having a concentration of 0.5% by mass relative to the total mass of the lubricant composition.

* * * * *